US007148813B2

(12) United States Patent
Bauer

(10) Patent No.: US 7,148,813 B2
(45) Date of Patent: Dec. 12, 2006

(54) LIGHT EMITTING TRAFFIC SIGN HAVING VEHICLE SENSING CAPABILITIES

(75) Inventor: Frederick T. Bauer, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 369 days.

(21) Appl. No.: 10/393,000

(22) Filed: Mar. 20, 2003

(65) Prior Publication Data

US 2004/0183694 A1 Sep. 23, 2004

(51) Int. Cl.
*G08G 1/095* (2006.01)

(52) U.S. Cl. ..... 340/907; 340/905; 340/933; 340/936

(58) Field of Classification Search ..... 340/906, 340/907, 908, 905, 933, 936, 994, 908.1, 340/910, 917
See application file for complete search history.

(56) References Cited

U.S. PATENT DOCUMENTS

| | | | | |
|---|---|---|---|---|
| 4,104,562 | A * | 8/1978 | DiCola | 315/158 |
| 5,457,449 | A * | 10/1995 | Kuning et al. | 340/908 |
| 5,635,902 | A | 6/1997 | Hochstein | |
| 5,935,190 | A | 8/1999 | Davis et al. | |
| 6,046,686 | A * | 4/2000 | Mitchell et al. | 340/936 |
| 6,222,462 | B1 | 4/2001 | Hahn | |
| 6,243,644 | B1 * | 6/2001 | Dengler | 701/117 |
| 6,559,774 | B1 * | 5/2003 | Bergan et al. | 340/908 |

* cited by examiner

*Primary Examiner*—Anh V. La
(74) *Attorney, Agent, or Firm*—Price, Heneveld, Cooper, DeWitt & Litton, LLP; James E. Shultz, Jr.

(57) ABSTRACT

A traffic system for alerting a driver of a motor vehicle to a traffic sign includes a sensor, a light source and a control unit. The sensor provides a motor vehicle detection signal and the control unit illuminates the light source responsive to the motor vehicle detection signal.

34 Claims, 1 Drawing Sheet

LIGHT EMITTING TRAFFIC SIGN HAVING VEHICLE SENSING CAPABILITIES

BACKGROUND OF THE INVENTION

The present invention is generally directed to an illuminated traffic sign and, more specifically, to an illuminated traffic sign that includes vehicle sensing capabilities.

Traffic signs have been utilized in various locations, e.g., at road intersections, road curves, along roads and at railroad crossings, to alert drivers of motor vehicles to various road hazards and applicable traffic regulations. A number of designers have incorporated one or more light sources within traffic signs and have incorporated traffic signs on certain motor vehicles, e.g., school buses. U.S. Pat. No. 5,635,902 discloses a school bus stop sign that is rotatably coupled to a school bus. The bus stop sign includes an array of light emitting diodes (LEDs) disposed on the stop sign to provide illumination. An associated flashing or pulsing circuit is utilized in conjunction with the LEDs, which may be arranged on a sign to define a word, such as "stop," and may be arranged on both sides of the bus stop sign. The pulsing circuit periodically provides current to the LEDs, which causes them to flash, enhancing the visibility of the bus stop sign to drivers of nearby vehicles and/or children entering and exiting the associated school bus.

U.S. Pat. No. 6,222,462 is directed to an apparatus for warning drivers of the presence of a concealed hazard, such as a concealed school bus stopping location. The apparatus includes a sign, adapted for installation along a highway, with associated warning lights and a receiver. The warning lights are periodically illuminated when the sign is in a warning mode, which occurs when the receiver receives a warning signal from a transmitter that may be located within a school bus. The receiver is electronically connected to electronic circuitry that includes a switch, which flashes the warning lights. In a disclosed embodiment, the warning lights include an LED array. In another disclosed embodiment, a solar panel provides power to recharge a rechargeable battery, which powers the receiver, warning lights and associated electronic circuitry.

U.S. Pat. No. 5,935,190 is directed to a traffic monitoring system that includes a Doppler radar transceiver, a video camera and a digital computer for processing a Doppler signal. The system also includes a video cassette recorder (VCR), a high-speed camera and a laptop computer for downloading control settings and a program from a diskette or memory card to the computer. The system automatically measures the speeds of vehicles, photographs vehicles that exceed a specified speed limit and records prevailing traffic conditions onto a video tape installed within the VCR. The Doppler radar transceiver generates a Doppler signal having a pair of channels. The phase of one channel, with respect to the other channel, provides an indication of whether a vehicle is approaching or receding from the Doppler radar transceiver.

As stated above, traffic signs, e.g., stop signs, speed limit signs, yield signs and railroad crossing signs, are widely utilized to alert a driver of a motor vehicle and to instruct a driver of a motor vehicle to take an appropriate action. However, in many cases, a traffic sign may be concealed from view due to an obstruction, such as tall vegetation, walls, buildings, billboards, a hill and/or a curve in a road. Further, drivers that are unfamiliar with a given area may fail to see a traffic sign, even when unobstructed, and, thus, fail to respond appropriately. As one particular example, the inventor's son was nearly killed and the vehicle he was driving was totaled when a young driver in a small pickup truck ran a stop sign at 55 mph and hit the vehicle in the lower section of the driver's door. The intersection was a two-way stop and the inventor's son was on a through road with no stop sign. The intersection offered no view of the orthogonal road approaching the intersection. In this case, the young driver was distracted and failed to observe a plainly visible stop sign. Such observation failures may be relatively frequent on country roads on the outskirts of populated areas, as any driver can become preoccupied or fail to notice a roadside warning sign with tragic results.

What is needed is a traffic sign that alerts a driver of a motor vehicle to the traffic sign such that the driver of the motor vehicle can take an appropriate action.

SUMMARY OF THE INVENTION

The present invention is directed to a traffic system for alerting a driver of a motor vehicle to a traffic sign that includes a sensor, a light source and a control unit. The sensor provides a motor vehicle detection signal and the control unit illuminates the light source responsive to the motor vehicle detection signal. In one embodiment, the control unit illuminates the light source when the detected motor vehicle is approaching the traffic sign. In other embodiments, the sensor is one or a combination of a light sensor, image sensor, passive infrared sensor and a radar sensor. According to another embodiment, the light source includes one or more light emitting diodes (LEDs). The system may include a power source, which includes a rechargeable battery and a solar panel.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
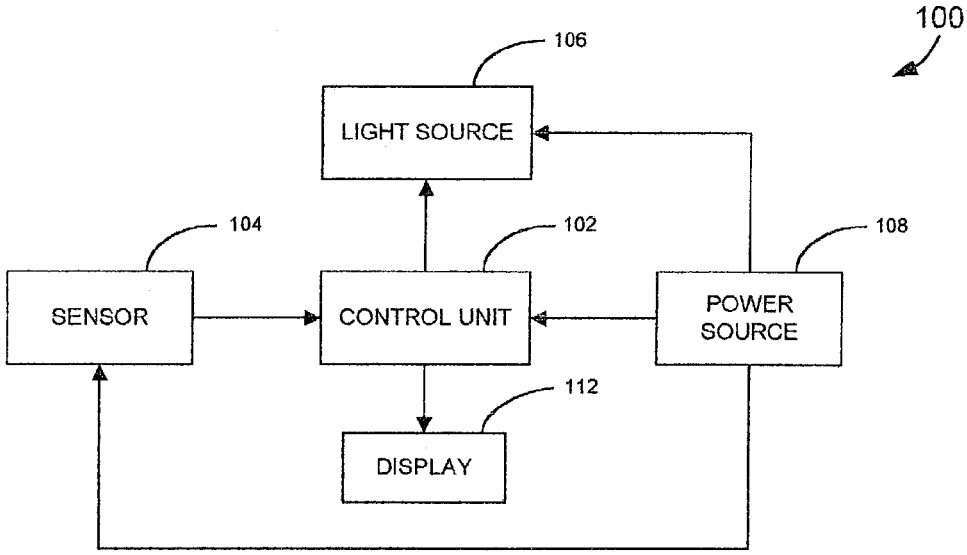
FIG. 1 is an electrical block diagram of a traffic system for alerting a driver of a motor vehicle to an associated traffic sign.

In the implementation of any traffic system, a designer must generally contend with issues of economics and environment. Mass produced intelligent interactive vehicular signage has the potential to make a two stop sign intersection nearly as safe as a conventional traffic light, which may cost fifty times as much, with less wasted time of drivers at the intersection, less wasted gasoline and less driver frustration. Seen another way, mass produced interactive signs with intelligence can cost effectively be used in ten to one hundred times more locations as conventional signs and signals, potentially saving tens of thousands of lives and hundreds of thousands of injuries and vehicular collisions.

According to one embodiment of the present invention, a driver approaching a sign is not alerted if their vehicle is performing in accordance with the sign. If, for instance, a driver's speed is within prescribed limits and a sensor indicates that a vehicle is slowing properly for a stop sign, then there is little reason to flash lights or otherwise distract a driver who obviously sees the stop sign. By the same token, if a vehicle is traveling within specified limits on a highway, there is little reason to use emitted light to draw a driver's attention to a speed limit sign that the driver is obviously obeying. The idea is to avoid alerting a driver when all is okay.

This also conserves energy and preserves a driver's piece of mind, avoiding nuisance warnings when there is no need.

On the other hand, if a driver is not slowing appropriately and is unlikely to stop for a stop sign, then a flashing light focused on the driver of the oncoming vehicle may optionally grow even more intense and flash more rapidly as it becomes clear that the driver does not see the sign and has little chance to stop appropriately. By the same token, if a speed limit sign indicates 70 mph and an oncoming vehicle is going 90 mph, then a focused signal may become more aggressive as danger increases.

That is, one aspect of the invention is do not bother drivers if they are performing properly and only attract driver attention when there is a safety need that is likely to result in an unsafe driving situation. The idea of putting the intelligence in the sign and not in the vehicle is another aspect of the invention. Putting intelligence in the vehicle is not a bad idea, but only the newest vehicles will have it. Putting intelligence in the sign itself means every vehicle that passes will benefit. Putting intelligence in every vehicle on the road is a somewhat impractical task, whereas putting intelligence in the signage benefits everyone, regardless of the age or cost of a vehicle. In addition, vehicles get old and eventually are junked, whereas intelligence in the signage generally has a much longer life with far greater economic and environmental efficiency for society.

An optional extension of this concept is to incorporate additional sensors for environmental factors that can affect safety, such as day, night, ice, snow, fog, temperature, rain, traffic density, etc. By using a reconfigurable display on the traffic sign, the driving instructions shown on the traffic sign can be adjusted based on environmental safety factors, with an attendant adjustment by the control circuit of the warning signal light to the approaching vehicle. The traffic sign then becomes increasingly intelligent with each technological advance.

Thus, the present invention is directed to a traffic system and method for alerting a driver of a motor vehicle to a traffic sign. The traffic system detects a motor vehicle and illuminates one or more light source(s) that are attached to the traffic sign responsive to one or more detected motor vehicle(s). According to one embodiment, the system is capable of determining whether the motor vehicle is approaching the traffic sign and only illuminating the light source(s) when the detected motor vehicle is approaching the traffic sign. This conserves power and, in situations where the traffic system is implemented with rechargeable batteries, can advantageously extend the operating life of the traffic system.

An even more energy conserving control and sensor technique is to sense a vehicle's speed and/or rate of change of speed to make the decision to illuminate the light source(s) on the signage only if the approaching vehicle is not performing within appropriate safety parameters. In this manner, the light signal is only transmitted to the oncoming vehicle when the vehicle is performing outside of prescribed safety criterion required for the purpose of the signage. The aggressiveness of the signal emitted from the sign may be commensurate with the degree to which the vehicle is performing outside the desired safety criterion and more aggressive signaling can be achieved by raising intensity and/or flash rate. Various types of sensors may be utilized to detect the motor vehicle, such as one or more of the following: a light sensor, an image sensor, a color enhanced image sensor, a passive infrared sensor (PSIR) radar sensor, an image intensified sensor, a stereoscopic image sensor, an IR emitter/receiver sensor, a twin PSIR sensor (using a first PSIR sensor for ambient and a second PSIR sensor aimed at the oncoming vehicle) and multiple light sensors aimed in different directions to balance out effects of ambient light. One optional light sensor is disclosed in U.S. Pat. No. 6,359,274, entitled PHOTODIODE LIGHT SENSOR, which is hereby incorporated herein by reference in its entirety.

In one embodiment, the plurality of light sources includes a plurality of light emitting diodes (LEDs) formed in an array. Suitable high-power LEDs are disclosed in U.S. Pat. No. 6,335,548, entitled SEMICONDUCTOR RADIATION EMITTER PACKAGE, which is hereby incorporated herein by reference in its entirety. In another embodiment, a power source for powering the sensor, the control unit and the plurality of light sources is provided by a rechargeable battery that receives energy from a solar panel or photovoltaic module.

Turning to FIG. 1, a control unit 102, e.g., including a microcontroller, is coupled to a sensor 104, a light source 106 and a display 112, when implemented. The control unit 102, the sensor 104, the light source 106 and the display 112, if implemented, receive power from a power source 108, which may include a solar panel that provides a recharging current to a rechargeable battery. The sensor 104 may be of a variety of types, depending upon the implementation, such as a light sensor, which detects light provided by the lighting system of an approaching motor vehicle, or may include a radar sensor, such as a Doppler radar transceiver, which is capable of determining whether a vehicle is approaching or receding from the sensor and/or determining speed and distance.

If a light sensor is utilized, it is preferable that the control unit 102 measure an ambient light level so as to select a threshold level to compare to the light level sensed at any particular instant. Such an ambient light level may be attained as an average level over a specified time interval. By setting a variable threshold as a function of the ambient light level, the control unit 102 may prevent the light sources from being inadvertently illuminated due to bright sunlight. Additionally, the threshold or a second threshold may be used to discriminate between headlights of approaching vehicles and tail lights of receding vehicles. Alternatively, discrimination between such vehicles may be accomplished by limiting the field of view of the sensor to that in which approaching vehicles are expected or using one or more optical filters, such as a red light blocking filter. The light source 106 may also take a variety of forms, e.g., a multicolored LED array of one or more incandescent bulbs. Alternately, the sign of FIG. 2 may not contain light emitters 106 but may contain only one focused light module 110 aimed at the driver of the oncoming vehicle for most efficient use of energy. One or more additional light sources may be incorporated in the signage as an auxiliary warning where the auxiliary light source(s) are aimed to alert non-offending vehicles of danger. For instance, with a two-way stop intersection, the main goal is to alert drivers approaching the stop sign to come to a full stop, but a secondary goal may be to energize amber warning lights to through traffic that there is imminent danger that a stop sign will be run, thus, allowing non-offending vehicles to slow or stop to avoid a crash.

Figure 2:
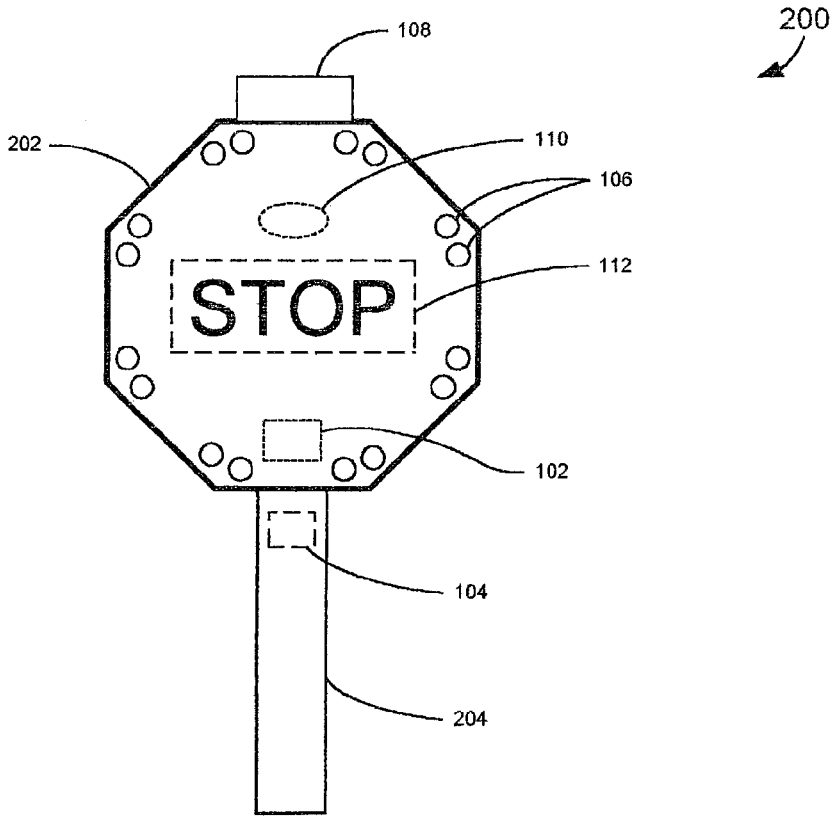
FIG. 2 is a diagram of a traffic control device that includes a traffic sign, a sensor, a light source and a control unit.

FIG. 2 depicts an exemplary traffic sign 202, i.e., a stop sign, which forms a part of a traffic control device 200. It should be appreciated that the present invention may be advantageously implemented within any number of different traffic signs. The traffic sign 202 is coupled to and supported by a post 204 in a conventional manner. Alternatively, the sign may be attached to a number of other support structures. As is shown in FIG. 2, the sign 202 includes a plurality of light sources 106 along an outer periphery of the sign 202. Alternatively, or in addition to, the lights 106 may form a part of the traffic direction, e.g., the word "stop" or the display 112 may be implemented to provide the traffic direction. Further, the sign 202 may not contain light emitters 106 but may contain only one focused light module 110 aimed at the driver of the oncoming vehicle for most efficient use of energy. As is also shown in FIG. 2, a sensor 104 is attached to the post 204. However, it should be appreciated that the sensor 104 may be combined within the traffic sign 202 or located at various other positions.

When the power source 108 includes a solar panel and a rechargeable battery, the power source 108 may be located along a top of the traffic sign 202 or otherwise oriented to receive light from the sun. A control unit 102 is coupled to the sensor 104 and the light source 106 and receives power from the power source 108. Responsive to a motor vehicle detection signal provided by the sensor 104, the control unit 102 may cause the light sources 106 and/or 110 to intermittently turn off and on, i.e., flash at a desired rate. The control unit 102 may also be configured to alter the flash rate and light intensity in response to the degree of danger posed by the oncoming vehicle. It should be appreciated that the present invention can be incorporated within any number of different types of traffic signs, e.g., a stop sign, a yield sign, a railroad crossing sign, a school sign, a curve sign, among other such signs.

Accordingly, a traffic control device has been described herein, which detects a vehicle and alerts a driver of the vehicle to the presence of the traffic sign by periodically illuminating a plurality of light sources. Illumination of the light sources upon detection of a motor vehicle can be particularly advantageous to a driver who is unfamiliar with the area in which they are driving or in bringing to the attention of the driver of the motor vehicle the presence of a traffic sign, which is otherwise obstructed from view.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A method for alerting a driver of a motor vehicle to a traffic sign, comprising the steps of:

detecting a motor vehicle; and illuminating at least one light source responsive to the detected motor vehicle when the detected motor vehicle is unlikely to act in conformance with said traffic sign, wherein illumination associated with said traffic sign is unaffected by the detected motor vehicle when the detected motor vehicle is likely to act in conformance with said traffic sign.

2. The method of claim 1, further including the steps of:

determining whether the motor vehicle is approaching the traffic sign; and illuminating the at least one light source only when the detected motor vehicle is approaching the traffic sign.

3. The method of claim 1, wherein the step of detecting the motor vehicle includes the step of detecting light provided by a lighting system of the motor vehicle with a light sensor.

4. The method of claim 1, wherein the step of detecting the motor vehicle includes the step of detecting the motor vehicle with a radar sensor.

5. The method of claim 1 wherein the step of detecting the motor vehicle includes the step of detecting the heat emission from the motor vehicle with an infrared sensor.

6. The method of claim 1, wherein the at least one light source includes one or more light emitting diodes (LEDs).

7. The method of claim 1 wherein the step of detecting the motor vehicle includes detecting at least one of a speed and rate of change in speed of an oncoming vehicle.

8. The method of claim 1, further including the step of:

providing a power source for powering a sensor, a control unit and the at least one light sources, wherein the power source includes a rechargeable battery couple to a solar panel and the control unit periodically illuminates the at least one light source responsive to a motor vehicle detection signal provided to the control unit from the sensor.

9. A traffic system for alerting a driver of a motor vehicle to a traffic sign, the system comprising:

a sensor for providing a motor vehicle detection signal;

at least one light source attached to the traffic sign; and a control unit coupled to the sensor and the at least one light source, the control unit illuminating the at least one light source responsive to the motor vehicle detection signal when the detected motor vehicle is unlikely to act in conformance with the traffic sign, wherein illumination associated with said traffic sign is unaffected by the detected motor vehicle when the detected motor vehicle is likely to act in conformance with said traffic sign.

10. The system of claim 9, wherein the control unit illuminates the at least one light source when the detected motor vehicle is approaching the traffic sign.

11. The system of claim 9, wherein the sensor includes a light sensor.

12. The system of claim 9, wherein the sensor includes a radar sensor.

13. The system of claim 9, wherein the at least one light source includes a plurality of light emitting diodes (LEDs).

14. The system of claim 9, wherein the control unit includes a microcontroller.

15. The system of claim 9, further including:

a power source for providing electrical power to the sensor, the at least one light source and the control unit, wherein the power source includes a rechargeable battery coupled to a solar panel.

16. A traffic control device for motor vehicles, comprising:

a traffic sign;

a sensor for providing a motor vehicle detection signal;

at least one light sources attached to the traffic sign; and a control unit coupled to the sensor and the at least one light source, the control unit periodically illuminating the at least one light source responsive to the motor vehicle detection signal when the detected motor vehicle is unlikely to act in conformance with the traffic sign, wherein illumination associated with said traffic sign is unaffected by the detected motor vehicle when the detected motor vehicle is likely to act in conformance with said traffic sign.

17. The device of claim 16, wherein the control unit illuminates the at least one light source when the detected motor vehicle is approaching the traffic sign.

18. The device of claim 16, wherein the sensor includes a light sensor.

19. The device of claim 16, wherein the sensor includes a radar sensor.

20. The device of claim 16, wherein the at least one light source includes a plurality of light emitting diodes (LEDs).

21. The device of claim 16, wherein the control unit includes a microcontroller.

22. The device of claim 16, further including:

a power source coupled to the sensor, the at least one light source and the control unit, wherein the power source includes a rechargeable battery coupled to a solar panel.

23. The device of claim 16, wherein the at least one light source is energized by the control unit only when the motor vehicle detection signal indicates an approaching vehicle is operating outside prescribed safety parameters that are programmed into the control unit.

24. A traffic control device for a stop sign, the device comprising:

a sensor for providing a motor vehicle detection signal;

at least one light source;

a control unit coupled to the sensor and the at least one light source, the control unit periodically illuminating the at least one light source responsive to the motor vehicle detection signal when the detected motor vehicle is not acting in conformance with a stop sign, wherein illumination associated with said traffic sign is unaffected by the detected motor vehicle when the detected motor vehicle is likely to act in conformance with said stop sign.

25. The device of claim 24, wherein the at least one light source is focused at a driver of an oncoming vehicle.

26. The device of claim 25, wherein the control unit causes the at least one light source to periodically flash when the control unit program determines that the oncoming vehicle is operating in a manner that indicates the vehicle is unlikely to stop for the stop sign.

27. The device of claim 26, wherein at least one of a flash rate and light intensity of at least one light source increases with increasing risk that the oncoming vehicle will fail to stop in the appropriate manner.

28. A traffic system for alerting a driver of a motor vehicle to the presents of a traffic sign, the system comprising:

a sensor for providing a motor vehicle detection signal, wherein the sensor is attached to the traffic sign;

at least one light source for emitting a light signal directed to a driver of an oncoming vehicle; and a control unit coupled to the sensor and to the at least one light source, wherein the control unit activates the at least one light source when the motor vehicle detection signal indicates that operation of the oncoming vehicle is likely to be in conflict with an instruction provided by the traffic sign, wherein illumination associated with said traffic sign is unaffected by the detected motor vehicle when the detected motor vehicle is likely to act in conformance with said traffic sign.

29. The traffic system of claim 28, wherein a power source for electrical powering the system is provided by one of a self-contained solar panel with a rechargeable battery and an electrical distribution system exterior to the sign.

30. The traffic system of claim 28, wherein a light signal is emitted from the at least one light source only in the event that the oncoming vehicle is operating outside desired safety parameters.

31. A self-contained traffic sign for motor vehicles, the sign comprising:

an electronic sensor for sensing of the motion of an oncoming vehicle;

a light for alerting a driver of the oncoming vehicle; and an electronic control unit for receiving input from the sensor and activating the light when the oncoming vehicle motion indicates that the oncoming vehicle is unlikely to perform in accordance with a purpose of the traffic sign, wherein illumination associated with said traffic sign is unaffected by the detected motor vehicle when the detected motor vehicle is likely to act in conformance with said traffic sign.

32. The sign of claim of 31, further including:

a power source for electrically energizing the sensor, the light and the electronic control unit, wherein the power source is provided by at least one of a self-contained solar panel with an associated rechargeable battery and a conventional AC power distribution system external to the traffic sign.

33. A traffic sign for motor vehicles, the sign comprising:

a detector for monitoring the motion of an approaching vehicle; and a light source coupled to the detector, wherein the light source provides a light warning signal when an approaching vehicle is unlikely to perform in accordance with a purpose of the traffic sign, and wherein illumination associated with said traffic sign is unaffected by the detected motor vehicle when the detected motor vehicle is likely to act in conformance with said traffic sign.

34. The traffic sign of claim 33, further comprising:

at least one sensor for detecting environmental conditions, wherein the at least one sensor detects at least one of rain, day, night, snow, ice, fog, temperature and traffic density; and a reconfigurable display visible in day or night wherein the display is configurable to provide a safe driving instruction based on the detected environmental conditions, and wherein the detected environmental conditions are utilized to energized the light source when the motion of an approaching vehicle is not in accordance with the instruction provided on the reconfigurable display.

* * * * *

UNITED STATES PATENT AND TRADEMARK OFFICE

CERTIFICATE OF CORRECTION

PATENT NO. : 7,148,813 B2
APPLICATION NO. : 10/393000
DATED : December 12, 2006
INVENTOR(S) : Frederick T. Bauer It is certified that error appears in the above-identified patent and that said Letters Patent is hereby corrected as shown below:

Col. 2, line 62
replace “their”
with --his/her--.

Col. 3, line 17
replace “do”
with --to--.

Col. 4, line 6
replace “ambient”
with --ambient light levels--.

Col. 6, line 22
replace “couple”
with --coupled--.

Col. 6, line 61
replace “sources”
with --source--.

Col. 7, line 49
replace “presents”
with --presence--.

Col. 8, line 6
replace “electrical”
with --electrically--.

Col. 8, line 15
replace “sensing of the”
with --sensing--.

Col. 8, line 26
replace “of 31”
with --31--.

UNITED STATES PATENT AND TRADEMARK OFFICE

CERTIFICATE OF CORRECTION

PATENT NO. : 7,148,813 B2
APPLICATION NO. : 10/393000
DATED : December 12, 2006
INVENTOR(S) : Frederick T. Bauer It is certified that error appears in the above-identified patent and that said Letters Patent is hereby corrected as shown below:

Col. 8, line 53
replace "energized"
with --energize--.

Signed and Sealed this

First Day of May, 2007

JON W. DUDAS
*Director of the United States Patent and Trademark Office*